US008932191B2

(12) United States Patent
Failer et al.

(10) Patent No.: US 8,932,191 B2
(45) Date of Patent: Jan. 13, 2015

(54) PORTABLE TRAINING DEVICE, IN PARTICULAR FOR ARM EXERCISES

(71) Applicant: Michael Failer, Bottighofen (CH)

(72) Inventors: Michael Failer, Bottighofen (CH); Diana Failer, Bottighofen (CH)

(73) Assignee: Michael Failer, Bottighofen (CH)

( * ) Notice: Subject to any disclaimer, the term of this patent is extended or adjusted under 35 U.S.C. 154(b) by 0 days.

(21) Appl. No.: 13/731,166

(22) Filed: Dec. 31, 2012

(65) Prior Publication Data

US 2013/0123080 A1 May 16, 2013

Related U.S. Application Data

(63) Continuation of application No. PCT/IB2011/052925, filed on Jul. 1, 2011.

(30) Foreign Application Priority Data

Jul. 1, 2010 (CH) ..... 1080/10

(51) Int. Cl.

| | |
|---|---|
| ***A63B 21/02*** | (2006.01) |
| ***A63B 21/00*** | (2006.01) |
| ***A63B 21/008*** | (2006.01) |
| ***A63B 23/12*** | (2006.01) |
| ***A63B 69/00*** | (2006.01) |
| *A63B 21/055* | (2006.01) |

(52) U.S. Cl.

CPC ..... *A63B 21/0012* (2013.01); *A63B 21/008* (2013.01); *A63B 21/0087* (2013.01); *A63B 21/1403* (2013.01); *A63B 21/1419* (2013.01); *A63B 23/12* (2013.01); *A63B 69/0059* (2013.01); *A63B 21/00072* (2013.01); *A63B 21/055* (2013.01); *A63B 21/1484* (2013.01)

USPC ..... 482/139; 482/124; 482/126; 482/112; 482/128

(58) Field of Classification Search

USPC ..... 482/44–50, 51, 74, 92, 111, 114, 482/121–130

See application file for complete search history.

(56) References Cited

U.S. PATENT DOCUMENTS

| | | | | |
|---|---|---|---|---|
| 866,495 | A * | 9/1907 | Marks | 482/124 |
| 3,768,808 | A * | 10/1973 | Passera | 482/114 |
| 4,436,097 | A * | 3/1984 | Cunningham | 600/520 |

(Continued)

FOREIGN PATENT DOCUMENTS

WO WO 2008/075928 6/2008

OTHER PUBLICATIONS

International Search Report of PCT/IB2011/052925, date of mailing Apr. 4, 2012.

*Primary Examiner* — Stephen Crow
*Assistant Examiner* — Rae Fischer
(74) *Attorney, Agent, or Firm* — Collard & Roe, P.C.

(57) ABSTRACT

The invention relates to a training device for fixing in the area of the human waist, composed of a belt-like element (2) and of at least one force element arranged on the belt-like element (2), wherein the force element is coupled at least indirectly to a grip element, and the force element has the property of providing a resistance force (tensile force) against the pull of the grip element. According to the invention, provision is made that the force element (4; 204) is additionally designed such that it also provides an opposing force (pressure force) when the grip element (4.3; 204.3) is moved back in the direction of the force element.

11 Claims, 3 Drawing Sheets

(56) References Cited

U.S. PATENT DOCUMENTS

| | | | | | |
|---|---|---|---|---|---|
| 4,441,707 | A | * | 4/1984 | Bosch | 482/131 |
| 5,190,512 | A | * | 3/1993 | Curran | 482/124 |
| 5,234,395 | A | * | 8/1993 | Miller et al. | 482/118 |
| 5,462,518 | A | | 10/1995 | Hatley et al. | |
| 5,476,435 | A | | 12/1995 | Nimmo | |
| 5,618,249 | A | | 4/1997 | Marshall | |
| 5,735,780 | A | * | 4/1998 | Fazio et al. | 482/112 |
| 5,916,070 | A | | 6/1999 | Donohue | |
| 6,790,162 | B1 | * | 9/2004 | Ellis et al. | 482/51 |
| 2005/0261113 | A1 | | 11/2005 | Wilkinson | |

* cited by examiner

PORTABLE TRAINING DEVICE, IN PARTICULAR FOR ARM EXERCISES

CROSS REFERENCE TO RELATED APPLICATIONS

This application is a continuation of and Applicant claims priority under 35 U.S.C. §120 of International Application No. PCT/IB2011/052925 filed on Jul. 1, 2011, which claims priority under 35 U.S.C. 119 of Swiss Application No. 01080/10 filed on Jul. 1, 2010. The international application under PCT article 21(2) was not published in English. The disclosure of the aforesaid International Application and Swiss application are incorporated by reference.

BACKGROUND OF THE INVENTION

The invention relates to a training device composed of a fixing means that can be fitted on the human body, particularly in the area of the waist. This device is suitable for moving the arms, in particular against a resistance, for example also during walking and speed-walking.

TECHNICAL FIELD

The positive effect that walking, jogging and running have on the human cardiovascular system and on muscle development is known. In particular, the muscles of the lower extremities of humans are strengthened by these types of sport. By contrast, the muscles of the upper body are scarcely exercised at all by running, walking, speed-walking or jogging.

In order to do this, sports such as power walking, Nordic walking or running with weights are known. These types of sport at least partially involve the upper body and thus provide training of the whole body.

PRIOR ART

US 2005/0261113 A1 discloses a portable training device that can be fitted like a belt in the waist area. To strengthen the muscles of the arms, it has force elements that have to be gripped by the hand and that are then accordingly moved counter to a resistance force. The resistance force is generated by the force element, which is arranged on the belt and designed like a roller. A grip element that is grasped by the hand is a component part of the force element. In the example provided, these elements are like gloves. The grip-like element is connected to a flexible band, which is received by the force element and wound onto the latter. The resistance movement is then performed, in accordance with the walking movements, counter to a corresponding spring force.

U.S. Pat. No. 5,476,435 likewise discloses a portable training device designed like a belt. Force elements are arranged at the sides and have grip-like elements at their free ends. The grip-like elements are connected to cylindrical elements, which provide the corresponding resistance force against the movement.

U.S. Pat. No. 5,618,249 also discloses a belt element in which a grip element, connected to a resistance element, can also be moved counter to a corresponding resistance force.

All of the resistance elements known from the prior art have the property of being able to be pulled counter to a force, wherein the grip element is guided back automatically to its starting position by virtue of the flexible design but also by virtue of the corresponding design of the force elements. The person using the training device does not perform any work to guide the grip elements back. This means that, in the forward movement of the arm, corresponding work has to be performed counter to a resistance force, whereas in the return movement the resistance force is zero, since the design of the force elements means that these can provide the resistance force only in one direction.

DISADVANTAGES OF THE PRIOR ART

Sports such as Nordic walking or power walking use devices like ski poles in order to ensure that active movement of the arms results in a corresponding movement in the area of the upper body. In particular if not done correctly, the physical exercise is insufficient, since the poles are then carried only as balancing aids or simply as things to be carried. A suitable and correct pattern of movement does not take place. Corrective aids that force the user to perform a suitable pattern of movement are likewise unknown. The noises that occur when using the poles are often considered annoying. Moreover, no provision is made to use sports devices of this kind indoors.

If it is desired to perform coordinated movements in closed spaces, training devices are known that exercise the foot and also the upper body region. However, these are very expensive, and they can therefore only be procured by fitness studios. Moreover, training with weights places a great strain on the body and can lead to injuries.

Regarding the cited prior art, it proves a disadvantage that, with the devices disclosed therein, a suitable resistance force against a movement can be provided only in one direction, i.e. unidirectionally. This means that, in a forward movement of the arm, force has to be exerted, since the force element provides the corresponding resistance force. On account of the restoring force provided by the force element, the grip element is now guided back automatically to its starting position, with or without the arm. In the process, the arm thus exerts no effort and therefore also performs no work. This also means that there is no permanent loading of the arms during the walking or speed-walking movement. Pauses occur within the movement cycle. If this is compared with the corresponding movement when skating (in the area of cross-country skiing), the configurations in the prior art, by contrast, provide movement only one way.

SUMMARY OF THE INVENTION

Problem Addressed by the Invention

The object of the invention is to improve the known training devices in such a way that, during walking, jogging or running, the activity of other parts of the body, in particular the arms, is supported and promoted since these can be moved to and fro counter to a force.

Solution to the Problem

The core concept of the invention is that work has to be expended against a force both during the forward movement and also during the return movement. This means that a pulling force and a pushing force both have to be applied.

The solution to the problem lies in the features according to the invention.

Advantages of the Invention

The device according to the invention is a training device that advantageously exercises the whole body of a human and additionally provides training effects when walking, jogging, speed-walking or running. The training device involves the upper body much more intensively than in Nordic walking, without placing additional loads on the joints of the human body, as is unavoidable, for example, when walking/running with weights. The intensity of the whole-body training can be clearly felt even during the first use of the training device, particularly through the relief of the spinal column in the lumbar region.

A further advantage of the fixing device according to the invention is that it is constructed like a belt. This means that a connection element is provided by which the belt-like design of the fixing device can be fitted in the waist area, such that it is fixed firmly against torsion in the waist area.

In order to permit an adaptation of the belt-like design to the anatomical shape of the waist area, it has a skeletal design. This means that it is configured by perpendicular bars that lead to better force distribution in the waist area. Textile fabric or plastic is arranged between the bars, the respective ends preferably having reinforcements, which also hold the bars at a defined distance from one another.

In one development, provision is made for trouser leg attachments to be formed on the belt-like structure, in order to compensate for the torsion that occurs through the use of the laterally inserted force elements. This preferably involves a trouser-like design of the fixing device, which can be closed medially like a belt by a closure element.

In an alternative, trousers are provided separate from the belt-like element and are also washable. To achieve the rotation stabilization that is needed to counteract the movements of the force elements, corresponding means are provided.

A further important advantage of the invention is that, on the fixing device, elements are provided that are able to hold various small items and devices, for example a fitness computer, cell phones, MP3 players, headphones, keys, an identity card, a handkerchief, medicines, a GPS system, beverage bottles, etc. By virtue of these arrangements, items can be safely stowed in such a way as to ensure that they do not impede this area of the body during the movement. Thus, all valuable and useful items can be carried around without restriction and without their getting in the way.

The force elements can be designed in different ways. In one illustrative embodiment, provision is advantageously made for them to be designed as so-called "pull and push sticks". This means that a gas-pressure spring is arranged preferably on anatomically pre-shaped grips. In order to move the grip during the corresponding walking or running movement, an opposing force (produced by the gas-pressure spring) has to be overcome (pull), whereas, for the guiding back, a corresponding opposing force (push) also has to be overcome, The force elements are arranged in such a way that they can be operated without restrictions using the respective hand, even when the arms move more strongly in faster running movements and perform circular and/or parabolic movements.

In a further development, provision is made that the force elements are adjustable, in such a way that the opposing force that is to be overcome is adjustable. When not in use, the force elements can be inserted in pockets that are provided, or they can also be completely removed.

In another development, the individually configured force elements described above are brought together at the back, such that the force elements are coupled in terms of force. If the right arm is guided forward (medially), the left arm is guided rearward (dorsally). The movement can be applied against an opposing force if at least one force element is positioned between them.

In other developments, provision is likewise made for the above-described opposing force to be adjustable.

The force elements described above can be configured in different ways. The purpose of these force elements is to build up an opposing force that counteracts the arm or hand movement. Thus, the force elements can be mechanical, but they can also be electrical or pneumatic. The mechanical configurations can take the form of rubber bands or spring elements, but also a form involving gas-pressure springs.

Firstly, the force elements can be provided by means of the grip elements being coupled by suitable rods to electromotive resistance brakes, for example an eddy-current brake, It is thus likewise possible that corresponding work has to be performed by the arms both during the forward movement and also during the backward movement. The particular advantage in the configurations with the eddy-current brake is that the latter is scalable by virtue of an electric circuit coupled to the eddy-current brake. This means that the work that has to be performed is adjustable on account of the corresponding resistance moment. For example, a low resistance moment can be set at the start for the forward and backward movements and can be suitably increased as training proceeds.

A further alternative embodiment of a force element can take the form of a centrifugal pump. This means that, as a result of the forward and backward movements, the fluid present in the centrifugal pump has to be moved against a resistance. By increasing the corresponding cross sections or reducing the cross sections, the resistance moment can also be accordingly scaled.

A purely mechanical solution is one in which the grip elements are provided with corresponding rod elements, which are in turn guided in a guide element. This guide element is designed such that it has two rotatably mounted rollers arranged at a distance from each other on one side of the rod element, whereas, on the opposite side, a third roller is rotatably mounted, preferably between the two rollers. A suitable three-point guide of the rod element is thus provided. If the clear width between the three-point bearing is reduced, the frictional force between the rollers and the rod element is thereby increased, which in turn affects the resistance force provided for performing the corresponding training procedures. This resistance magnitude is also scalable according to requirements.

All of the embodiments that have been mentioned above can also in each case be arranged on one side, such that different resistance forces are provided for the left and right arms. An asynchronous movement of the arms is thus also possible.

However, if this is not wanted, and if instead the technique is preferred which is used in Nordic walking, skating and cross-country skiing and in which, for example, the left arm is directed forward and the right arm rearward, and vice versa, then it is proposed that both grip elements be coupled to a common rod element, in which case the rod element is preferably guided or mounted dorsally over the three-point bearing, the eddy-current brake or the vane pump. An aim of the device according to the invention is that the movement directions of the grip elements and of their rod elements for the actual force element are such that the physiological movement during walking, speed-walking and running is maintained. Developments are proposed in which the grip elements and also the rod elements can be folded away or removed and are designed technically in such a way that they have the lowest possible weight. A particular design is one in which the grip elements and rod elements are combined with flexible light-weight elements, in order to reduce the weight accordingly.

The fixing device according to the invention can be used by top athletes, amateur athletes, patients during rehabilitation, and occasional sportsmen and women as a whole-body training device, both indoors on treadmills and also outside closed spaces. Depending on the intended physical demands and/or the desired training effect, the force applied for the upper body muscles can be predefined by individually adjusting the force elements and, if so desired, can be monitored by corresponding monitoring devices that can additionally be applied.

Further advantageous embodiments are set out in the following description, in the drawings and in the claims.

DESCRIPTION OF SEVERAL ILLUSTRATIVE EMBODIMENTS

Figure 1:
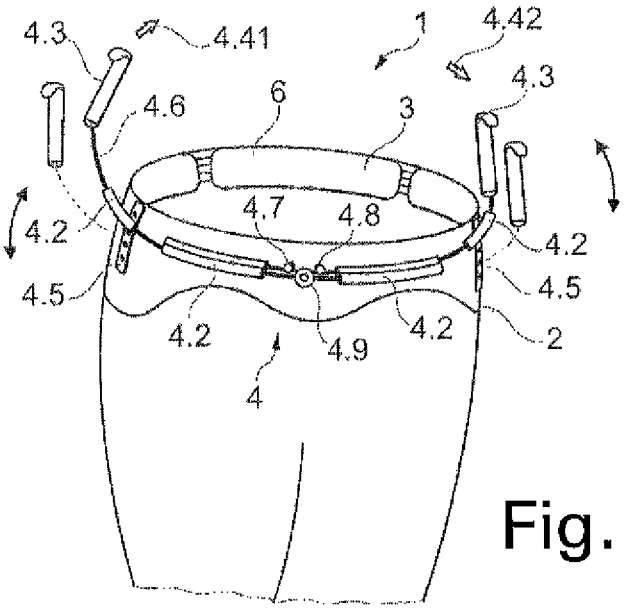
FIG. 1 shows a schematic view of a first illustrative embodiment of the training device according to the invention, in a dorsal view.
Figure 2:
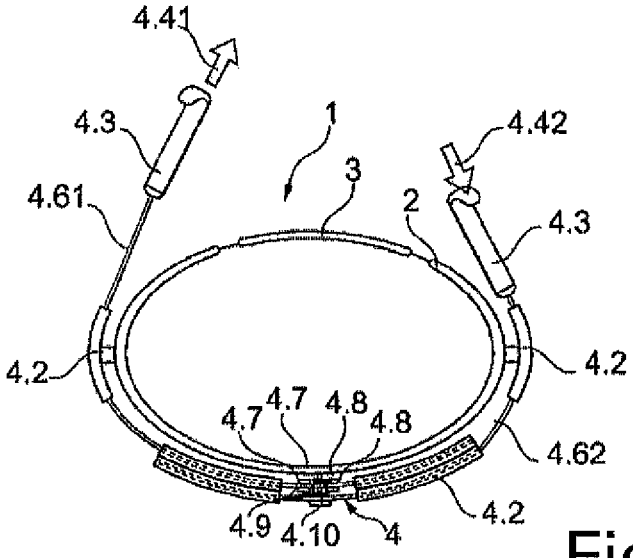
FIG. 2 shows a plan view of the training device according to FIG. 1, in a functional modification of FIG. 1.
Figure 4:
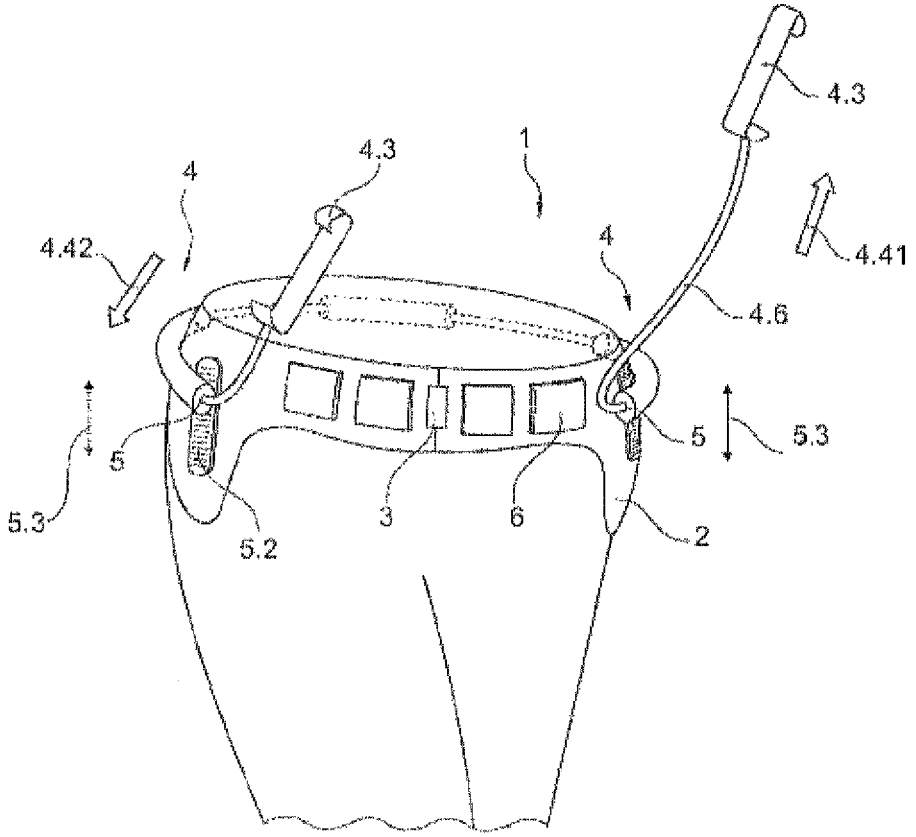
FIG. 4 shows another perspective view (from the front) of the illustrative embodiment according to FIG. 1.

FIGS. 1, 2 and 4 show a first illustrative embodiment of a training device 1. The training device 1 is composed of a belt-like element 2 that can be fitted round the hips of a human. To obtain the appropriate width of the belt-like element 2, a closure element 3 is provided, which is arranged medially and is preferably designed like a buckle. Of course, it is also possible to provide different types of connection elements that have a belt-like character. Laterally, that is to say on each side (on the left and right in FIG. 1), grip elements 4.3 are arranged that are grasped in the hands by the user. These grip elements 4.3 are connected by a defined device to a force element 4 shown here.

In the illustrative embodiment shown here, the two grip elements (left and right) are connected directly to each other by a connection element, for example in the form of a flexible rod 4.6. This means that if the left-hand grip element is moved in arrow direction 4.4, the right-hand element 4.4.1 moves in arrow direction 4.4.2. This also applies accordingly the other way round. The flexible rod 4.6 is mounted in guide sleeves 4.2, which are each arranged in a fixed position on a belt-like element and allow the flexible rod 4.6 to be guided through them. The laterally arranged guide sleeves 4.2 in particular can be suitably varied in height via adjustment elements 4.5, in order thereby to permit an ergonomic movement of the arms.

In the illustrative embodiment shown in FIGS. 1, 2 and 4, the two grip elements 4.3 are, as has already been mentioned, coupled to each other via a flexible rod 4.6. In the functional modification which is shown in FIG. 2, and which itself follows the principle of FIG. 1, different flexible rods 4.6 are used for the left-hand side and also for the right-hand side of the respective grip elements 4.3. In this way, asynchronous movements are also accordingly possible. A common feature of both embodiments is the corresponding force element 4. This force element has two rollers 4.7 and 4.8 arranged spaced apart on one side of the flexible rod, whereas a larger roller 4.9 is preferably provided on the opposite side, particularly between the two rollers 4.7 and 4.8. In this way, the flexible rod is mounted in what is called a three-point bearing. If it is desired that the resistance moment, which is provided by the friction of the bearing inside the force element, the clear width between the rollers 4.7 and 4.8 and the further roller 4.9 is reduced, such that the clamping force for mounting the flexible rod becomes greater and the resistance moment correspondingly increases in direction 4.4.1 and also in the opposite direction. In order to adjust this, an adjustment element 4.10 in the form of a screw is provided, as can be seen in the plan view of FIG. 2 for example. In this way, the appropriate adjustment can also be performed by hand at the back, without having to see this force element.

In the illustrative embodiment shown in FIG. 2, several rollers are provided, these then being provided separately for the respective flexible rod 4.6.1 or 4.6.2.

Figure 3:
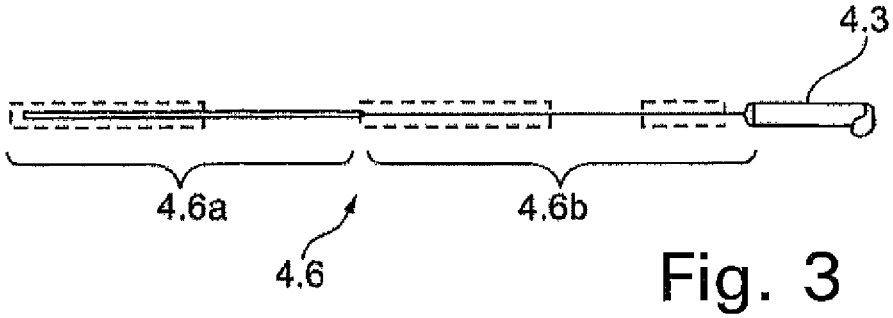
FIG. 3 shows a grip element with a connection element for coupling to the force element, shown schematically.

The flexible rod 4.6 is shown schematically in FIG. 3. It is preferably divided into two areas, namely a first area 4.6*a* and another area 4.6*b*. The first area 4.6*a* is characterized by coming into contact with the force element and is statically and dynamically designed in accordance with its mechanical overload. The other part 4.6*b* can have a simple design and can also be thin in respect of its statics, since it does not come into contact with the force element and instead needs to have the appropriate flexibility to ensure that the natural movement of the arms can be performed. The other part 4.6*b* is then adjoined by the grip element 4.3.

Figure 5:
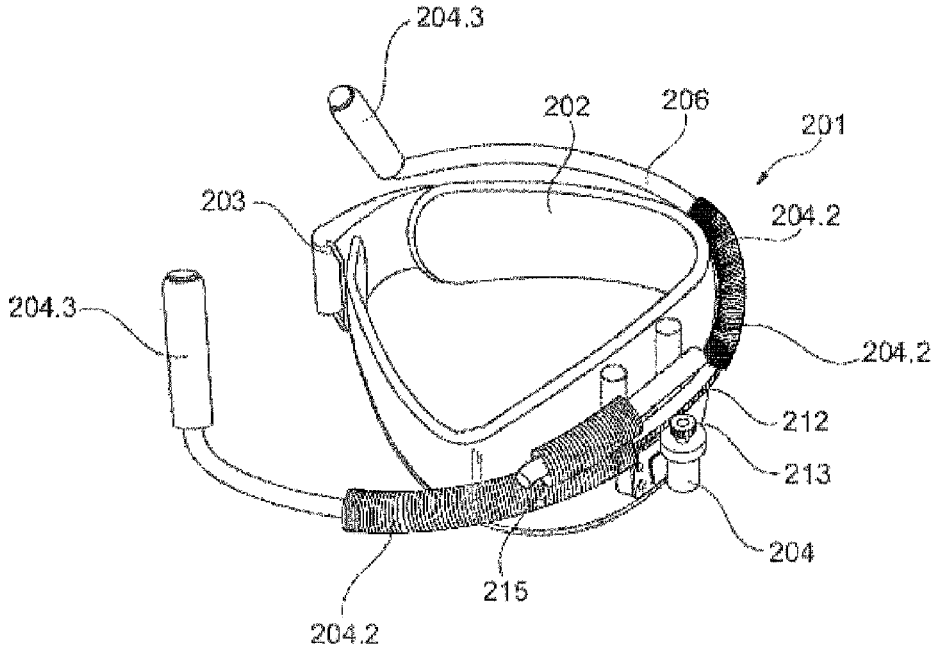
FIG. 5 shows a perspective view of another illustrative embodiment of the device according to the invention.
Figure 6:
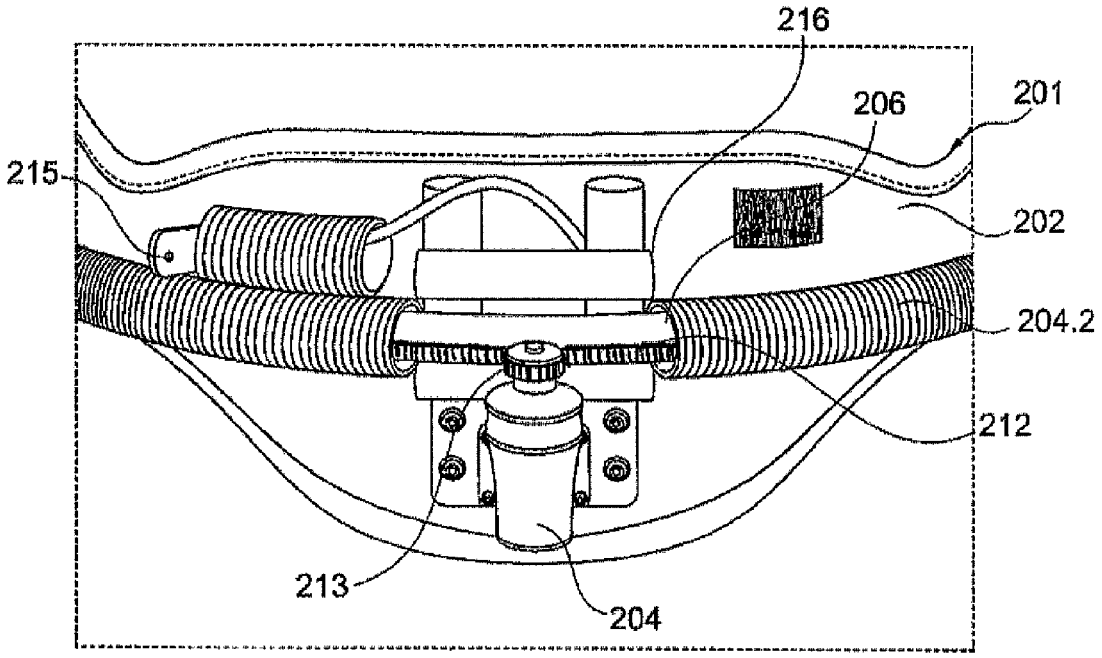
FIG. 6 shows an enlarged view of the force element of the training device according to FIG. 6.

FIGS. 5 and 6 show another illustrative embodiment of the training device 201 according to the invention. The training device 201 according to the invention is composed of a belt-like element 202 that can be fitted round the hips of a human. In order to obtain the appropriate width of the belt-like element 202, a closure element 203 is provided, which is arranged medially and is designed like a buckle. Of course, it is possible to provide different types of connection elements that have a belt-like character.

A force element 204 is arranged centrally at the back and is coupled to a rigid rod element 204.2. The rigid rod element 204.2 is curved according to the body shape and has grip elements 204.3 at its ends. The rod 206 is mounted in guide elements 204.2, which are likewise arranged in a fixed position on the belt-like element 202. At the back, the rod-shaped element 206 has a connecting surface 212, which is in contact with the force element 204. A form-fit and force-fit connection is preferably provided here. In the illustrative embodiment shown here, the connecting element 212 is a rod-like shape, which engages with a toothed wheel 213 of the force element 204. The force element 204 is an eddy-current brake, which can be regulated in terms of its magnitude via a corresponding current supply and via a regulator 215. This form-fit and force-fit connection serves merely as an illustrative embodiment. Instead, it is possible to provide any types of force-fit and form-fit connection that permit the corresponding transfer of the resistance force of the force element 204, The additional mounting in this area is provided by further bearing elements 216, which are likewise arranged dorsally on the belt-like element 202.

In a development of the belt-like elements 2, 202, pockets 6, 206 are also provided on the surface and/or circumference thereof. The pockets 6, 206 are suitable for holding utensils and small devices, for example a fitness computer, cell phones, MP3 players, keys, an identity card, handkerchiefs, medicines, GPS systems, beverage bottles or similar.

In order to ensure greater torsional stiffness at the user's waist, the belt-like element 2 has a leg attachment 7, which is preferably firmly connected to the belt-like element 2. This leg attachment can be made of cloth, for example, but also of plastic, such that the desired stiffness is achieved.

Alternatively, the rotation forces of the belt-like element 2, 202 can also be transferred to tracksuit bottoms by the cloth, in which case the two elements can be fixed by buttons, velcro fasteners or similar. In one development, the articulation of the force elements 4, 204 on the belt-like element 2, 202 is removable, such that said force elements can be easily detached or replaced.

The advantages of the training device according to the invention are, on the one hand, that training times can be massively reduced by comparison with jogging, and several parts of the body are involved simultaneously in the training. Arms, shoulders, chest and back are involved during the training session and exercised.

The load on the spinal column is reduced, and the support muscles of the spinal column are correspondingly built up and stamina significantly increased.

The technical device according to the invention is a very compact training device that can be kept in any bag and can thus be carried around without problems.

What is claimed is:

1. A training device for fixing in the area of the human waist, the training device comprising a belt-like element, a first force element arranged on the belt-like element, and a second force element arranged on the belt-like element, wherein the first force element is coupled at least indirectly to a first grip element, wherein the first force element provides a first resistance force against a pull of the first grip element, wherein the first force element also provides a further first opposing force when the first grip element is moved back in a direction of the first force element, wherein the first force element is a first eddy-current brake, wherein a second grip element is coupled at least indirectly to the second force element, wherein the second force element provides a second resistance force against a pull of the second grip element, and wherein the second force element provides a further second opposing force when the second grip element is moved back in a direction of the second force element.

2. The training device as claimed in claim 1, wherein the second force element comprises a gas-pressure spring, and wherein the gas-pressure spring has a piston cylinder and a piston rod.

3. The training device as claimed in claim 1, wherein the resistance force of the first eddy-current brake is scalable by a first electrical adjustment device.

4. The training device as claimed in claim 1, wherein the second force element is a pump with a closed fluid circuit.

5. The training device as claimed in claim 1, wherein an articulation of the first force element on the belt-like element is adjustable.

6. The training device as claimed in claim 1, wherein the belt-like element has a circumference and at least one pocket-like element on the circumference.

7. The training device as claimed in claim 1, wherein the first resistance force is a tensile force.

8. The training device as claimed in claim 1, wherein the first opposing force is a pressure force.

9. The training device as claimed in claim 1, wherein the second force element is a second eddy-current brake.

10. The training device as claimed in claim 9, wherein the resistance force of the second eddy-current brake is scalable by a second electrical adjustment device.

11. The training device as claimed in claim 1, wherein an articulation of the second force element on the belt-like element is adjustable.

* * * * *